US010526879B2

(12) United States Patent
Oliveira et al.

(10) Patent No.: US 10,526,879 B2
(45) Date of Patent: Jan. 7, 2020

(54) INJECTION RATE TUNING FOR OILFIELD OPERATIONS

(71) Applicant: HALLIBURTON ENERGY SERVICES, INC., Houston, TX (US)

(72) Inventors: Rafael Menezes Oliveira, Rio de Janeiro (BR); Flavio Henrique Marchesini, Rio de Janeiro (BR)

(73) Assignee: Halliburton Energy Services, Inc., Houston, TX (US)

( * ) Notice: Subject to any disclaimer, the term of this patent is extended or adjusted under 35 U.S.C. 154(b) by 435 days.

(21) Appl. No.: 15/302,384

(22) PCT Filed: Dec. 23, 2015

(86) PCT No.: PCT/IB2015/059953

§ 371 (c)(1),
(2) Date: Oct. 6, 2016

(87) PCT Pub. No.: WO2017/109553

PCT Pub. Date: Jun. 29, 2017

(65) Prior Publication Data

US 2018/0016882 A1 Jan. 18, 2018

(51) Int. Cl.
*E21B 43/16* (2006.01)
*E21B 44/00* (2006.01)

(52) U.S. Cl.
CPC ..... *E21B 43/16* (2013.01); *E21B 44/00* (2013.01)

(58) Field of Classification Search
CPC ..... E21B 43/16
USPC ..... 166/305.1
See application file for complete search history.

(56) References Cited

U.S. PATENT DOCUMENTS 3,771,598 A 11/1973 McBean
4,319,635 A 3/1982 Jones et al.
4,372,381 A 2/1983 McMillen et al.
4,456,066 A 6/1984 Shu et al.
(Continued)

OTHER PUBLICATIONS

Dias et al., Minimization of Viscous Fluid Fingering: A Variational Scheme for Optimal Flow Rates, Phys Rev Lett., vol. 109, 2012, pp. 1-5.

(Continued)

*Primary Examiner* — Silvana C Runyan
(74) *Attorney, Agent, or Firm* — Kilpatrick Townsend & Stockton LLP

(57) ABSTRACT

Optimized enhanced oil recovery can include tuning of injection rates during a recovery operation. The injection rate of injection fluid pumped into a formation can be controlled to alternate between monotonically increasing and monotonically decreasing during the enhanced recovery operation. Injection rates can be monotonically increased to a maximum level (e.g., as defined by physical constraints of the system) and then monotonically decreased to a lower level, allowing the injection rates to be monotonically increased again. While injection rates are monotonically increasing, viscous fingering between the injection fluid and hydrocarbons can be minimized while the hydrocarbons in the formation are displaced. While injection rates are monotonically decreasing, creation of new viscous fingers can be minimized while the injection rates are decreased to levels suitable for the monotonic increasing phase of a subsequent monotonic cycle.

14 Claims, 11 Drawing Sheets

(56) References Cited

U.S. PATENT DOCUMENTS

| | | | | |
|---|---|---|---|---|
| 5,382,411 | A * | 1/1995 | Allen | B01F 3/1271 366/153.1 |
| 5,963,138 | A * | 10/1999 | Gruenhagen | E21B 21/08 175/40 |
| 6,851,444 | B1 * | 2/2005 | Kohl | E21B 37/06 137/13 |
| 2012/0168158 | A1 | 7/2012 | Nasr et al. | |

OTHER PUBLICATIONS

Homsy, Viscous Fingering in Porous Media, Annual Review of Fluid Mechanics, vol. 19, Jan. 1987, pp. 271-311.

John et al., Variable density and viscosity, miscible displacements in horizontal Hele-Shaw cells. Part 2. Nonlinear simulations, J. Fluid Mech., vol. 721, 2013, pp. 295-323.

Li et al., Control of Viscous Fingering Patterns in a Radial Hele-Shaw Cell, Physical Review Letters, vol. 102, 2009, pp. 1-4.

International Patent Application No. PCT/IB2015/059953, International Search Report and Written Opinion, dated Sep. 23, 2016, 15 pages.

Sayavedra et al., A Discussion of Different Approaches for Managing the Timing of EOR Projects, Society of Petroleum Engineers, SPE Enhanced Oil Recovery Conference, SPE-165304, 2013, pp. 1-6.

Tunio et al., Comparison of Different Enhanced Oil Recovery Techniques for Better Oil Productivity, International Journal of Applied Science and Technology, vol. 1, No. 5, Sep. 2011, pp. 143-153.

* cited by examiner

INJECTION RATE TUNING FOR OILFIELD OPERATIONS

CROSS-REFERENCE TO RELATED APPLICATIONS

This is a U.S. national phase under 35 U.S.C. 371 of International Patent Application No. PCT/IB2015/059953, titled "Injection Rate Tuning for Oilfield Operations" and filed Dec. 23, 2015, the entirety of which is incorporated herein by reference.

TECHNICAL FIELD

The present disclosure relates to oilfield recovery operations generally and more specifically to control of injection rates for enhanced oilfield recovery.

BACKGROUND

In oilfield recovery operations, enhanced recovery operations can involve providing additional energy into a wellbore to enhance the recovery of hydrocarbons (e.g., oil or other oilfield products) from a formation. Enhanced recovery operations may be desirable (e.g., cost effective) when the benefit form the additional recovery of hydrocarbons outweighs the cost of providing additional energy to the wellbore. Thus, it can be desirable to increase the efficiency and efficacy of enhanced recovery operations.

One enhanced recovery operation is secondary recovery, in which an external fluid, such as water or gas, is injected into a formation to ensure the formation pressure is maintained higher than the pressure of the producing wellbore. Another enhanced recovery operation is tertiary recovery, in which injection of other products can be used to increase hydrocarbon production. These methods can include polymer flooding, steam injection, in-situ combustion, and microbial enhanced oil recovery. Polymer flooding can modify the surface tension between displacing and displaced fluids, and possibly alter the trajectory of the injected fluids to boost production. Steam injection and in-situ combustion can heat the hydrocarbons to increase its mobility by reducing its viscosity. Microbial enhanced oil recovery can be used to treat and break down hydrocarbon chains to make them easier to recover.

BRIEF DESCRIPTION OF THE DRAWINGS

The specification makes reference to the following appended figures, in which use of like reference numerals in different figures is intended to illustrate like or analogous components.

DETAILED DESCRIPTION

Figure 1:
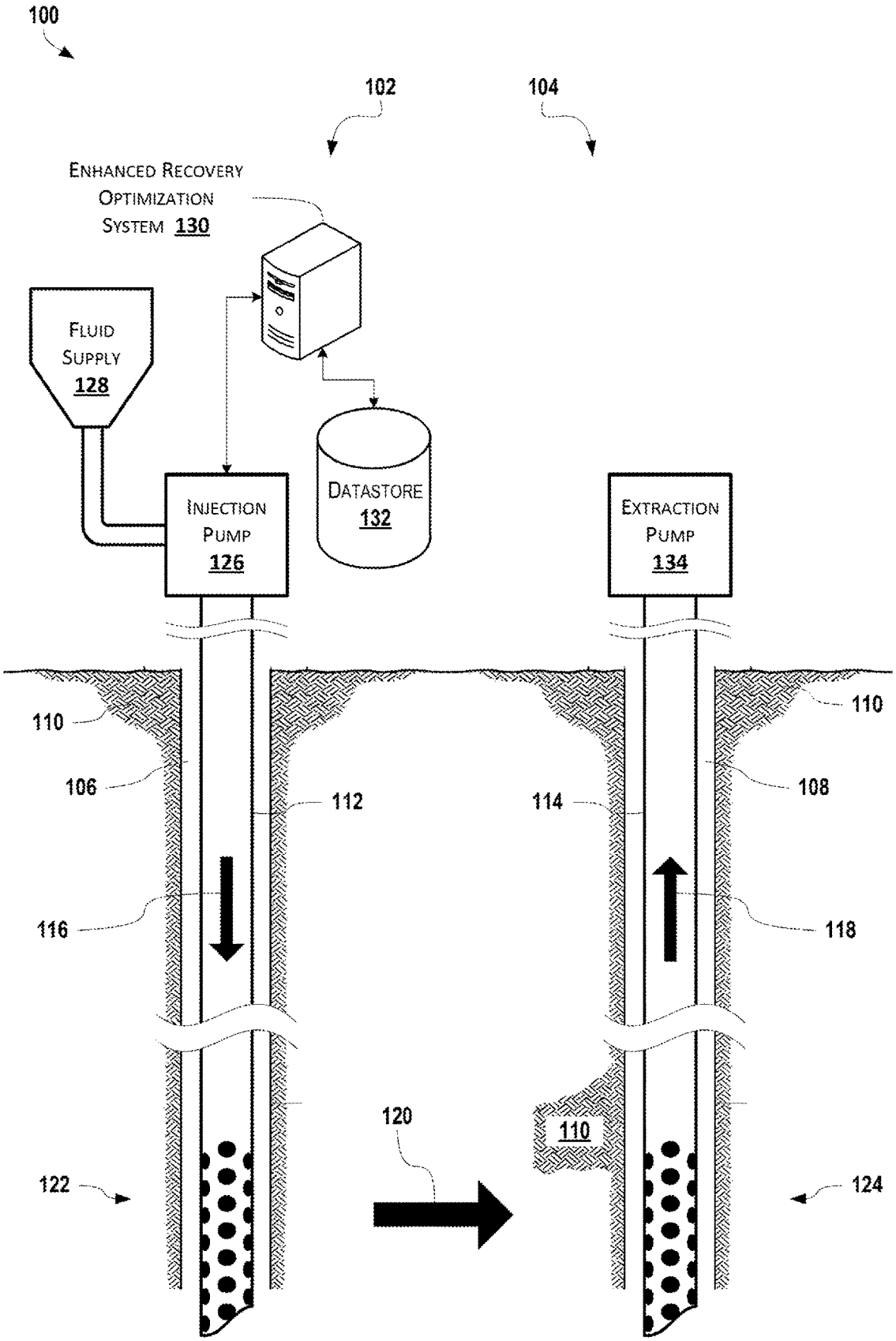
FIG. 1 is a combination schematic and block diagram of an enhanced oil recovery system including a wellbore injection system and a wellbore servicing system according to certain aspects of the present disclosure.

Certain aspects and features of the present disclosure relate to improving enhanced oil recovery techniques through injection rate tuning, such as monotonic cycling of injection rates. Monotonic cycling injection rates can include monotonically increasing and monotonically decreasing the injection rates. Monotonically increasing an injection rate includes increasing the injection rate over a duration without decreasing the injection rate during the duration. Monotonically decreasing an injection rate includes decreasing the injection rate over a duration without increasing the injection rate during the duration. Injection fluid can be pumped into a formation by an injection pump, displacing hydrocarbons in the formation, to facilitate recovery of hydrocarbons by a production well adjacent the formation. The injection rate of injection fluid pumped into a formation can be controlled to alternate between monotonically increasing and monotonically decreasing during the enhanced recovery operation. Injection rates can be monotonically increased to a maximum level (e.g., as defined by physical constraints of the system) and then monotonically decreased, before repeating the monotonic cycling. While injection rates are monotonically increasing, viscous fingering between the injection fluid and hydrocarbons can be minimized while the hydrocarbons in the formation are displaced. While injection rates are monotonically decreasing, creation of new viscous fingers can be minimized while the injection rates are decreased to levels suitable for the monotonic increasing phase of a subsequent monotonic cycle. Monotonic increasing of injection rates can occur by controlling an injection pump to increase its pump rate for a duration. Monotonic decreasing of injection rates can occur by controlling an injection pump to gradually reduce its pump rate or entirely cease operation for a duration.

Enhanced recovery methods involve the displacement of a viscous fluid (e.g., oil) by another viscous fluid, the injection fluid. In this displacement processes, the less viscous fluid can penetrate and finger through the more viscous material, thus giving rise to the onset and evolution of a hydrodynamic instability known as viscous fingering. Viscous fingering can include portions of a less viscous fluid penetrating into and extending into a volume of the more viscous fluid, resulting in a convoluted and unstable interface between the two fluids. When viscous fingering occurs, increased pressure of the lower viscosity fluid may result in substantial channeling through the higher viscosity fluid. This channeling behavior of the injected fluids can significantly reduce the displacement efficiency of the process. For example, viscous fingering can result in a significant portion of hydrocarbons in the formation remaining unrecovered and can require increased expenditure of pumping power and injection fluid to achieve the acceptable hydrocarbon recovery. In some cases, a critical situation can occur when a channel or finger of injected fluid reaches a production wellbore, in which case it can become difficult for that well to resume hydrocarbon production.

The viscosity difference between the injection fluid and displaced fluid affect the prevalence of and patterns associated with viscous fingering at the interfaces between the fluids. Higher viscosity fluids can invoke more severe viscous fingering, which can negatively impact the extraction rate under non-optimized enhanced recovery methods.

Linear growth rates of immiscible displacements (e.g., water as the injection fluid) in porous media (e.g., a formation) of a viscous fluid (e.g., hydrocarbons) by a less viscous fluid (e.g., injection fluid) can be defined by the balance between opposing terms. The first term can be a destabilizing term that promotes viscous fingering growth that is modulated by the injection rate and the viscosity ratio between the fluids. The second term can be a stabilizing term driven by surface tension. These growth rates can also be influenced by other terms, including heterogeneities of the media, gravity, and chemical reactions, among others. In miscible displacements (e.g., carbon dioxide as the injection fluid), surface tension may not play a role and dispersion relations on the interface between the injection fluid and hydrocarbons can act to damp instability growth of small waves. Tuned injection as disclosed herein can reduce the aforementioned growth rates and consequently result in oil displacements with improved efficiency.

Hydrocarbons in a formation can occur in a wide range of viscosities, such as gasoline having a low viscosity and tar having thick viscosity. Using non-optimized enhanced recovery, the occurrence of or threat of viscous fingering can cause the recovery of high-viscosity hydrocarbons to occur at lower extraction rates as compared to low-viscosity hydrocarbons. In enhanced recovery operations, it can be desirable to displace both low and high viscosity fluids with high efficiency. The onset and evolution of hydrodynamic instabilities can also be affected by other parameters, such as surface tension between immiscible fluids and diffusive mixing between miscible fluids. Additionally, when vertical mixing is present, gravity can influence the formation of hydrodynamic instabilities.

Non-optimized enhanced recovery can generally involve supplying an injection fluid at a constant rate. Certain aspects and features for optimizing enhanced recovery operations can include tuning injection rates to minimize the occurrence or threat of viscous fingering while injecting a sufficient volume of injection fluid for the desired recovery. Injection tuning can include providing injection fluid using time-dependent injection rates. Injection tuning can be applied to any suitable enhanced recovery operations, such as secondary and tertiary recovery. Examples of suitable injection fluids include liquids or gases, such as water, polymeric and surfactant solutions, and carbon dioxide.

Tuning injection rates can include monotonically cycling the injection rates of an injection fluid being provided to a formation. Monotonic cycling of an injection rate includes monotonic increasing and monotonic decreasing of the injection rate. Injection rates can be estimated, such as based on injection pump settings, or can be measured, such as based on a flow sensor operatively coupled to the injection pump or subsequent tubulars (e.g., injection workstring).

Monotonic cycling can include monotonically increased the injection rate for a duration, such as a preset amount of time or until a maximum limit is reached. The maximum limit can be based on a desired preset (e.g., user-inputted value) or a maximum limit of equipment (e.g., pumping limit of the injection pump or pressure limit of interconnected equipment). In some cases, the duration can extend until a signal is received from equipment monitoring the production wellbore or production equipment, such as a signal indicating rapid or unexpected changes in production pressure. During monotonic increasing, the injection rate can be increased from an initial value to a final value without undergoing any decrease in injection rate during the duration. In other words, a monotonically increasing injection rate can be defined by Equation 1, where Q(t) is an injection rate, t is time, and Δt is a positive time increment in the time domain of interest.

$$Q(t+\Delta t) \geq Q(t) \qquad \text{Equation 1}$$

Examples of suitable monotonically increasing functions include piece-wise constant functions, linear functions, polynomial functions, logistic functions, exponential functions, power functions, and logarithmic functions, among others. In some cases, monotonic increasing of the injection rate can include periods of increasing injection rate interrupted by one or more periods of constant (e.g. non-increasing) injection rate.

Monotonic cycling can include monotonically decreasing the injection rate for a duration, such as a preset amount of time or until a minimum limit is reached. Monotonic decreasing can occur subsequent to monotonically increasing the injection rate, such as when the injection rate as approached the maximum limit. The minimum limit can be based on a desired preset (e.g., user-inputted value) or a minimum limit necessary to maintain formation pressure at or above the pressure of the production wellbore. In some cases, the monotonic decreasing can continue until the injection pressure reaches the initial value of injection pressure of a previous monotonic increasing operation. During monotonic decreasing, the injection rate can be decreased from an initial value to a final value without undergoing any increase in injection rate during the duration. In other words, a monotonically decreasing injection rate can be defined by Equation 2, where Q(t) is an injection rate, t is time, and Δt is a positive time increment in the time domain of interest.

$$Q(t+\Delta t) \leq Q(t) \quad \text{Equation 2}$$

Examples of suitable monotonically decreasing functions include piece-wise constant functions, linear functions, parabolas, exponential functions, power functions, and logarithmic functions, among others.

In some cases, monotonic decreasing of the injection rate can include periods of decreasing injection rate interrupted by one or more periods of constant (e.g. non-decreasing) injection rate. Monotonic decreasing of the injection rate can include halting injection of injection fluid (e.g., stopping the injection pump) for a duration and allowing the injection rate to decrease. Monotonic decreasing of the injection rate can include controlling the injection pump to gradually decrease the pressure applied by the injection pump to allow the injection rate to decrease. Monotonic decreasing of the injection rate can be generally linear, exponential, parabolic, logarithmic, according to a power law, or the like. In some cases, it can be desirable to decrease the injection rate inversely proportional to the cubic root of time, such as shown in Equation 3, where Q(t) is the injection rate and t is time.

$$Q(t) \propto \frac{1}{\sqrt[3]{t}} \quad \text{Equation 3}$$

In some cases, monotonic cycling of the injection rate can include holding the injection rate constant for a period of time before monotonically cycling the injection rate again. In some cases, monotonic cycling of the injection rate can include holding the injection rate constant for a period of time between monotonically increasing and monotonically decreasing the injection rate.

In some cases, enhanced recovery operations can include the use of a set of injection wellbores, each located at a distance from a production wellbore. Monotonic cycling of injection rates can be applied individually to each of the injection wellbores or collectively across a set of injection wellbores. When injection rate tuning is applied individually, the injection rate attributable to a single injection wellbore is monotonically cycled. When injection rate tuning is applied collectively, the combined injection rate attributable to the set of injection wellbores is monotonically cycled. In collectively applied injection rate tuning, the injection rate of an individual injection wellbore of a set may be decreasing or increasing while the collective injection rate of the set of injection wellbores monotonically increases or decreases, respectively.

Enhanced recovery operations may be especially suitable to formations having highly viscous hydrocarbons and deep formations. Optimizing enhanced recovery through injection rate tuning can positively impact the economy and life cycle of the reservoirs in which enhanced recovery techniques are applicable. Optimizing enhanced recovery through injection rate tuning can also increase the efficiency of enhanced recovery techniques sufficiently to allow enhanced recovery to be suitable for certain reservoirs for which non-optimized enhanced recovery would be prohibitively expensive (e.g., expensive as measured in cost, resource consumption, or time expenditure). Optimized enhanced recovery through injection rate tuning can beneficially maintain efficiency and safety despite unexpected occurrences, such as unexpected hydrocarbons of unexpected viscosities in the formation.

In some cases, optimized enhanced recovery techniques as disclosed herein can use the same volume of injection fluid over the same amount of time as non-optimized enhanced recovery techniques, however with improved hydrocarbon displacement (e.g., recovery of more hydrocarbons from the formation) due to minimized hydrodynamic instabilities (e.g., viscous fingering).

The techniques and systems disclosed herein can be used with existing enhanced oil recovery techniques to achieve improved recovery. For example, aspects and features of the present disclosure can be used to optimize existing enhanced oil recovery techniques such as water-alternating-gas techniques or polymer flooding techniques. For example, when polymers or surfactants are injected during an enhanced oil recovery operation, these products may act on the interface between injected and displaced fluids to alter the rheology and surface tension of one or more of the fluids. As a result, dynamics of the viscous fingers may be altered, possibly making them wider, which may lead to improved recoveries. In some cases, optimal efficiency can be achieved through a combination of optimal formulation of injection fluid and optimal injection rate control using the techniques disclosed herein. For example, while certain formulations of injection fluid can improve the width of fingers that may form, injection rate control can delay the formation of those fingers, with a combined effect of further improved recovery. As used herein, an injection fluid may or may not include supplemental chemicals selected to result in formulations of injection fluids that improve the efficiency of an enhanced recovery operation.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may not be drawn to scale.

FIG. 1 is a combination schematic and block diagram of an enhanced oil recovery system 100 including a wellbore injection system 102 and a wellbore servicing system 104 according to certain aspects of the present disclosure. The wellbore injection system 102 includes an injection wellbore 106 penetrating a subterranean formation 110 for the purpose of injecting an injection fluid into the formation 110. The wellbore servicing system 104 includes a production wellbore 108 penetrating the subterranean formation 110 at a distance from the injection wellbore 106. The wellbores 106, 108 can be drilled into the subterranean formation 110 using any suitable drilling technique. The wellbores 106, 108 can be vertical, deviated, horizontal, or curved over at least some portions of the wellbores 106, 108. The wellbores 106, 108 can be cased, open hole, contain tubing, and can include a hole in the ground having a variety of shapes or geometries.

An injection workstring 112 can be supported in the injection wellbore 106 and a production workstring 114 can be supported in the production wellbore 108. One or more service rigs, such as a drilling rigs, completion rigs, workover rigs, or other mast structures or combinations thereof can support the workstrings 112, 114 in the wellbores 106, 108 respectively, but in other examples, different structures can support the workstrings 112, 114. For example, an injector head of a coiled tubing rigup can support one of the workstrings 112, 114. In some aspects, a service rig can include a derrick with a rig floor through which one of the workstrings 112, 114 extends downward from the service rig into one of the wellbores 106, 108. The servicing rig can be supported by piers extending downwards to a seabed in some implementations. Alternatively, the service rig can be supported by columns sitting on hulls or pontoons (or both) that are ballasted below the water surface, which may be referred to as a semi-submersible platform or rig. In an off-shore location, a casing may extend from the service rig to exclude sea water and contain drilling fluid returns. Other mechanical mechanisms that are not shown may control the run-in and withdrawal of the workstrings 112, 114 in the wellbores 106, 108. Examples of these other mechanical mechanisms include a draw works coupled to a hoisting apparatus, a slickline unit or a wireline unit including a winching apparatus, another servicing vehicle, and a coiled tubing unit.

The injection workstring 112 can be an injection string for providing an injection fluid to the formation 110. A fluid supply 128 can provide a supply of injection fluid. Examples of suitable injection fluids include liquids and gases, such as water, carbon dioxide, nitrogen, natural gas, polymeric and surfactant solutions, and the like. The fluid supply 128 can include tanks, reservoirs, hoses, pumps, or other equipment. Example fluid supplies include ground storage tanks, tanker vehicles, water towers, lakes, and the like. An injection pump 126 can pressurize the injection fluid into workstring 112 in direction 116. At an appropriate depth, openings 122 can allow the injection fluid to pass out of the workstring 112 and into the formation 110. Openings 122 can include apertures, valve-controlled ports, or other openings in a tubular, such as a workstring 112 or a tool coupled to the workstring 112. Packers and other equipment can be used to ensure injection fluid does not flow in the annulus between the workstring 112 and inner diameter of the wellbore 106.

As injection fluid is injected into the formation 110 by the wellbore injection system 102, hydrocarbons in the formation 110 are displaced in direction 120 and the internal pressure of the formation 110 increases. The displacement in direction 120 occurs in a direction extending from the injection wellbore 106 to the production wellbore 108. Hydrocarbons in the formation 110 adjacent the production wellbore 108 can pass into openings 124 of workstring 114 and be conveyed up the workstring 114. Openings 124 can include apertures, valve-controlled ports, or other openings in a tubular, such as a workstring 114 or a tool coupled to the workstring 114. An extraction pump 134 can be used to facilitate production of hydrocarbons by providing a negative pressure at an end of the workstring 114 opposite the openings 124. Packers and other equipment can be used to ensure injection fluid does not flow in the annulus between the workstring 114 and inner diameter of the wellbore 108.

Production pressure can refer to the pressure in the wellbore servicing system 104 that must be overcome by the pressure in the formation (e.g., formation pressure) to produce hydrocarbons from the formation 110. Production pressure can include bottomhole pressure of the production wellbore 108. Production pressure can include hydrostatic pressure of the workstring 114, including any decrease in pressure applied by an extraction pump 134.

Injection fluid can be provided at injection rates sufficient to maintain the pressure of the formation higher than the pressure of the wellbore servicing system 104 (e.g., pressure within workstring 114). Additionally, injection fluid can be provided in sufficient amounts to displace hydrocarbons in the formation 110 in direction 120 (e.g., towards the production wellbore 108) so that more hydrocarbons can be produced by the wellbore servicing system 104.

FIGS. 2-5 are cross-sectional views of a segment of formation 210 containing hydrocarbons 250 taken across a plane perpendicular to the direction of gravity at different times during an injection procedure.

Figure 2:
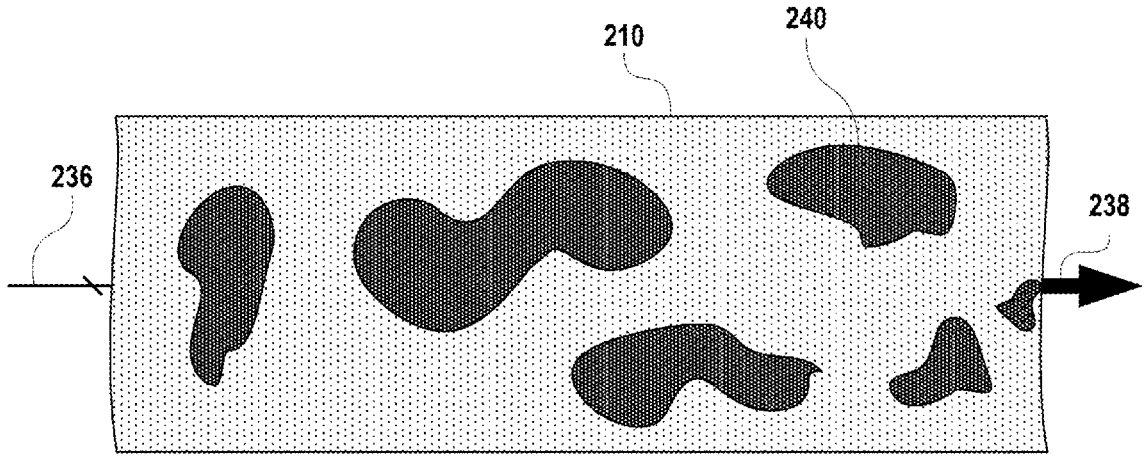
FIG. 2 is a cross-sectional view of a segment of formation containing hydrocarbons prior to enhanced recovery operations according to certain aspects of the present disclosure.

FIG. 2 is a cross-sectional view of a segment of formation 210 containing hydrocarbons 240 prior to enhanced recovery operations according to certain aspects of the present disclosure. The formation 210 can contain various hydrocarbons 240, such as oil, at distances away from a production wellbore. At least a portion of the hydrocarbons 240 may not be recoverable using primary recovery methods relying on formation pressure alone. Recovery of these hydrocarbons 240 may be accomplished using enhanced recovery techniques, such as pressurizing injection fluid into the formation 210 via an injection path 236 and extracting the hydrocarbons 240 via a recovery path 238. The injection path 236 can include any equipment, tubulars, and wellbores used to convey pressurized injection fluid to the formation 210. Examples of parts of an injection path 236 can include the injection pump 126, injection workstring 112, and injection wellbore 106 of FIG. 1. The recovery path 238 can be any equipment, tubulars, and wellbores used to convey hydrocarbons 240 from the formation 210 to the surface. Examples of parts of a recovery path 238 can include the extraction pump 134, production workstring 114, and production wellbore 108 of FIG. 1.

As seen in FIG. 2, the enhanced recovery operations have not commenced and thus no injection fluid has been provided via the injection path 236. Some degree of hydrocarbons 240 may be recovered via the recovery path 238 due to inherent formation pressure and the use of an extraction pump.

Figure 3:
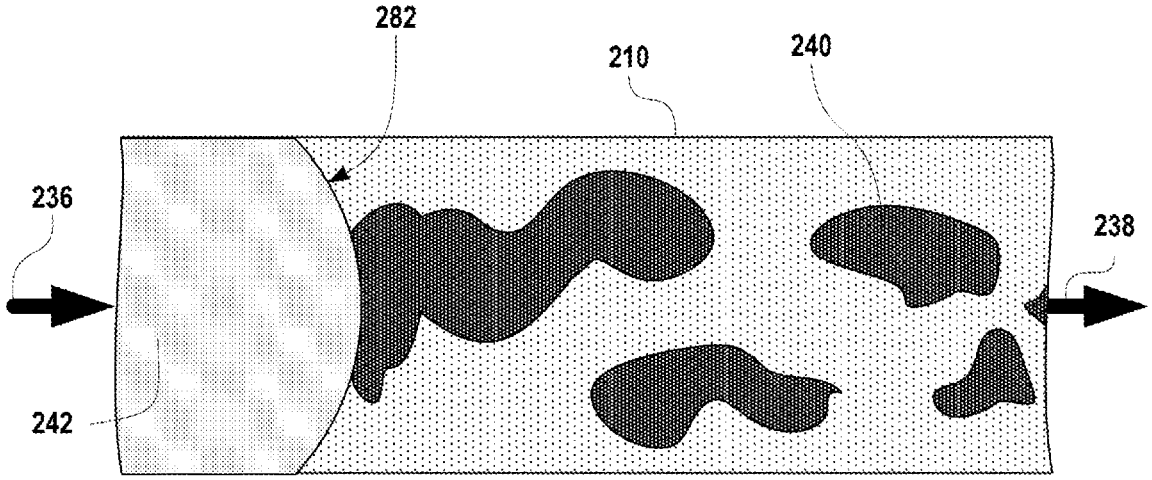
FIG. 3 is a cross-sectional view of the segment of formation of FIG. 2 at the start of a monotonically increasing phase of an enhanced recovery operation according to certain aspects of the present disclosure.

FIG. 3 is a cross-sectional view of the segment of formation 210 of FIG. 2 at the start of a monotonically increasing phase of an enhanced recovery operation according to certain aspects of the present disclosure. At the start of the monotonically increasing phase, injection fluid 242 is initially pressurized into the formation 210, via injection path 236, at a first injection rate. The first injection rate can be sufficient to force the injection fluid 242 into the formation 210 (e.g., overcoming formation pressure). As the injection fluid 242 is pressurized into the formation 210, it can pass through pores and openings in the formation and approach hydrocarbons 240. During the monotonically increasing phase, the injection rate of the injection fluid 242 can be monotonically increased. The start of the monotonically increasing phase can occur at the beginning of an enhanced recovery operation or following a prior monotonically decreasing phase, as described in greater detail herein.

The monotonically increasing phase can continue for a certain duration or until the injection rate reaches a maximum level or upper limit. The maximum level or upper limit can be defined by the engineering limits of the wellbore injection system, such as the operation limits of the injection pump. In some cases, a maximum level or upper limit can be selected based on other criteria, such as model outputs or operator-selected values. In some cases, the monotonically increasing phase can continue until a feedback signal is received, such as from a pressure sensor coupled to the recovery path 238.

By monotonically increasing the injection rate of the injection fluid 242, viscous fingering between the injection fluid 242 and the hydrocarbons 240 can be minimized. The hydrocarbons 240 can be displaced by the injection fluid 242 in a direction towards the recovery path 238, whereupon at least a portion of the hydrocarbons 240 can be conveyed to the surface via the recovery path 238.

As shown in FIG. 3, at the start of a monotonically increasing phase, the displacement front 282 of the injection fluid 242 is relatively small due to the relatively small amount of volume of injection fluid 242 that has been injected into the formation 210. As the monotonically increasing phase progresses, the amount of volume of injection fluid 242 increases and thus the displacement front 282 will expand in size (e.g., expand in radius). As the displacement front 282 expands in size, the pressure exerted by the injection fluid 242 is applied to a larger interface, and thus the pressure at any particular point along the interface may be insufficient to develop hydrodynamic instabilities such as viscous fingers. Monotonically increasing the injection rate as the displacement front 282 expands allows the system to take advantage of the lower risk of hydrodynamic instabilities later in the monotonically increasing phase by increasing the injection rates. Thus, higher injection rates can be used without substantial risk of hydrodynamic instabilities. Since the monotonically increasing phase is limited (e.g., by equipment constraints), it can become desirable to decrease the injection rate through a monotonically decreasing phase so that a subsequent monotonically increasing phase can occur.

Figure 4:
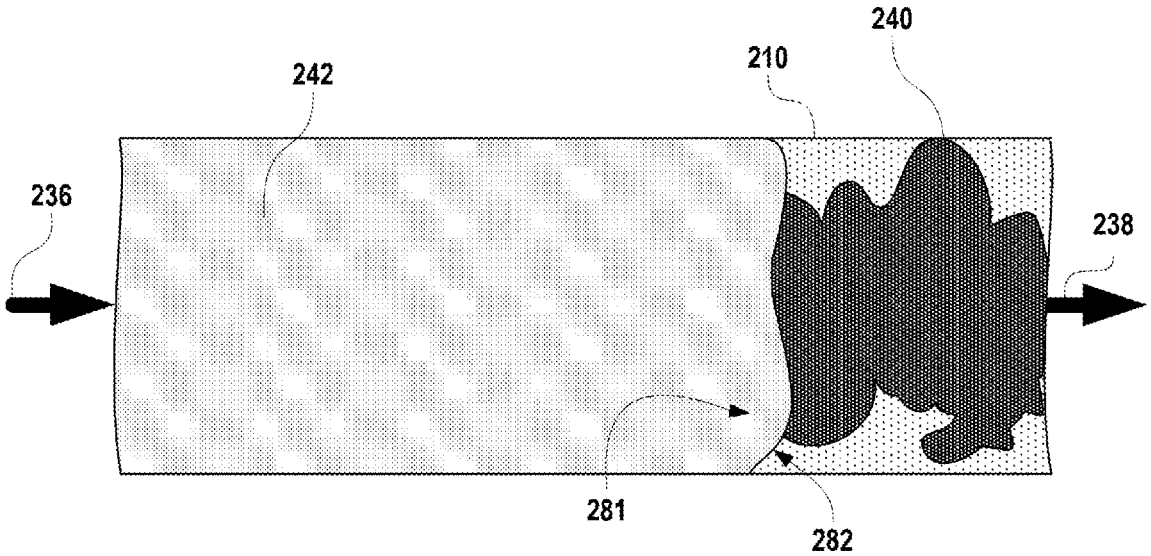
FIG. 4 is a cross-sectional view of the segment of formation of FIG. 2 after a duration of a monotonically increasing phase of an enhanced recovery operation using injection rate tuning according to certain aspects of the present disclosure.

FIG. 4 is a cross-sectional view of the segment of formation 210 of FIG. 2 after a duration of a monotonically increasing phase of an enhanced recovery operation using injection rate tuning according to certain aspects of the present disclosure. Since additional injection fluid 242 has been conveyed to the formation 210 as compared to the volume of injection fluid 242 at the start of the monotonically increasing phase (e.g., as seen in FIG. 3), the displacement front 282 is substantially larger. In some cases, one or more fingers 281 can form at the interface 282 between the injection fluid 242 and the displaced fluid 240. Due to the monotonically increasing rate of injection, however, fingering can be delayed or minimized as compared to constant injection rate operations.

A duration of a monotonically increasing phase can be followed by additional monotonically increasing or by a monotonically decreasing phase. In some cases, a monotonically decreasing phase follows the monotonically increasing phase directly, while in other cases the monotonically decreasing phase follows a period of constant injection rate that occurs after a monotonically increasing phase. During a monotonically decreasing phase, the injection rate of the injection fluid 242 provided via the injection path 236 can be monotonically decreased. Even during the monotonically decreasing phase, however, the injection rate may still remain positive, and thus injection fluid 242 can continue to be pressurized into the formation 210 and can continue to displace the hydrocarbons 240.

A monotonically decreasing phase can continue for a certain duration or until the injection rate reaches a minimum level or lower limit. In some cases, the minimum level or lower limit can be zero (e.g., the pressure supplying the injection fluid 242 to the formation 210 is offset by the formation pressure). In some cases, the minimum level or lower limit can be determined based on model outputs or operator-selected values. In some cases, the minimum level or lower limit can be selected to maximize one or both of the volume of injection fluid 242 provided to the formation 210 and the length of time spent in monotonically increasing phases throughout the entire enhanced recovery operation. In some cases, the monotonically decreasing phase can continue until a feedback signal is received, such as from a pressure sensor coupled to the recovery path 238. By monotonically decreasing the injection rate of the injection fluid 242, viscous fingering between the injection fluid 242 and the hydrocarbons 240 can be further minimized. The hydrocarbons 240 can continue to be displaced by the injection fluid 242 in a direction towards the recovery path 238, whereupon at least a portion of the hydrocarbons 240 can be conveyed to the surface via the recovery path 238. A monotonically decreasing phase can prepare the wellbore injection system for a subsequent monotonically increasing phase.

Figure 5:
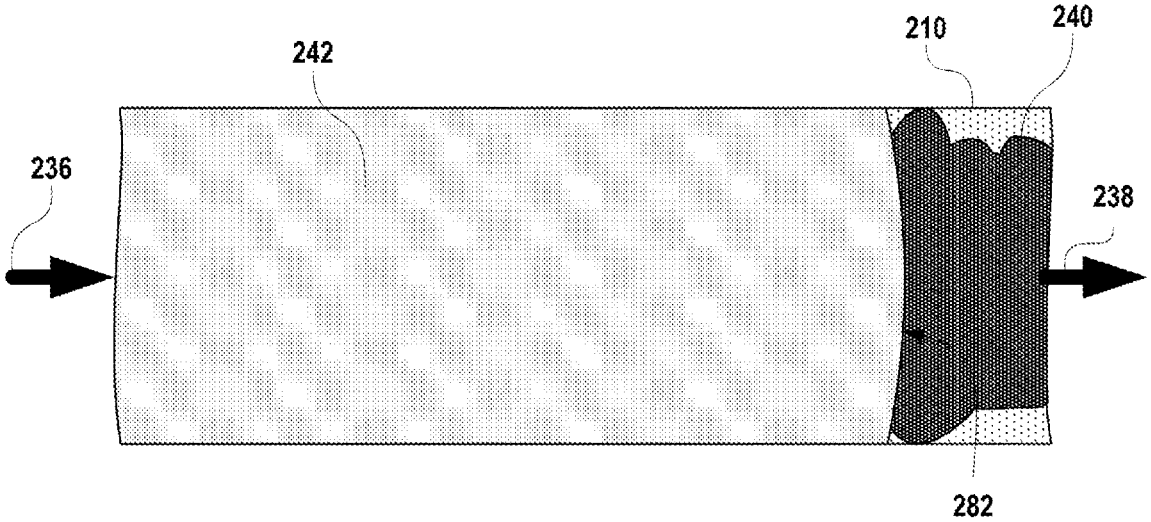
FIG. 5 is a cross-sectional view of the segment of formation of FIG. 2 after a duration of a monotonically increasing phase of an enhanced recovery operation using combined injection rate tuning and injection fluid formulation according to certain aspects of the present disclosure.

FIG. 5 is a cross-sectional view of the segment of formation 210 of FIG. 2 after a duration of a monotonically increasing phase of an enhanced recovery operation using combined injection rate tuning and injection fluid formulation according to certain aspects of the present disclosure. By combining injection rate tuning and injection fluid formulation, the efficiency of the enhanced oil recovery operation can be improved. The view depicted in FIG. 5 is the same view depicted in FIG. 4, however in addition to injection rate tuning, optimized injection fluid formulation techniques are used. In other words, the injection rate tuning in FIG. 5 is applied to injection fluids that have been formulated to achieve improved efficiency, whereas the injection rate tuning in FIG. 4 has been applied to standard injection fluid. Therefore, the injection fluid 242 supplied by the injection path 236 is formulated, such as with polymeric and surfactant solutions, to improve characteristics of the injection fluid 242. The combination of injection rate tuning and optimized injection fluid formulation can improve the efficiency of recovering hydrocarbons 240 from the formation 210 via the recovery path 238.

The operation of FIG. 5 can result in injection fluid 242 being conveyed into the formation 210 so that the displacement front 282 (e.g., interface) between the injection fluid 242 and the displaced fluid 240 forms fewer fingers than formed in the operation of FIG. 4.

Figure 6:
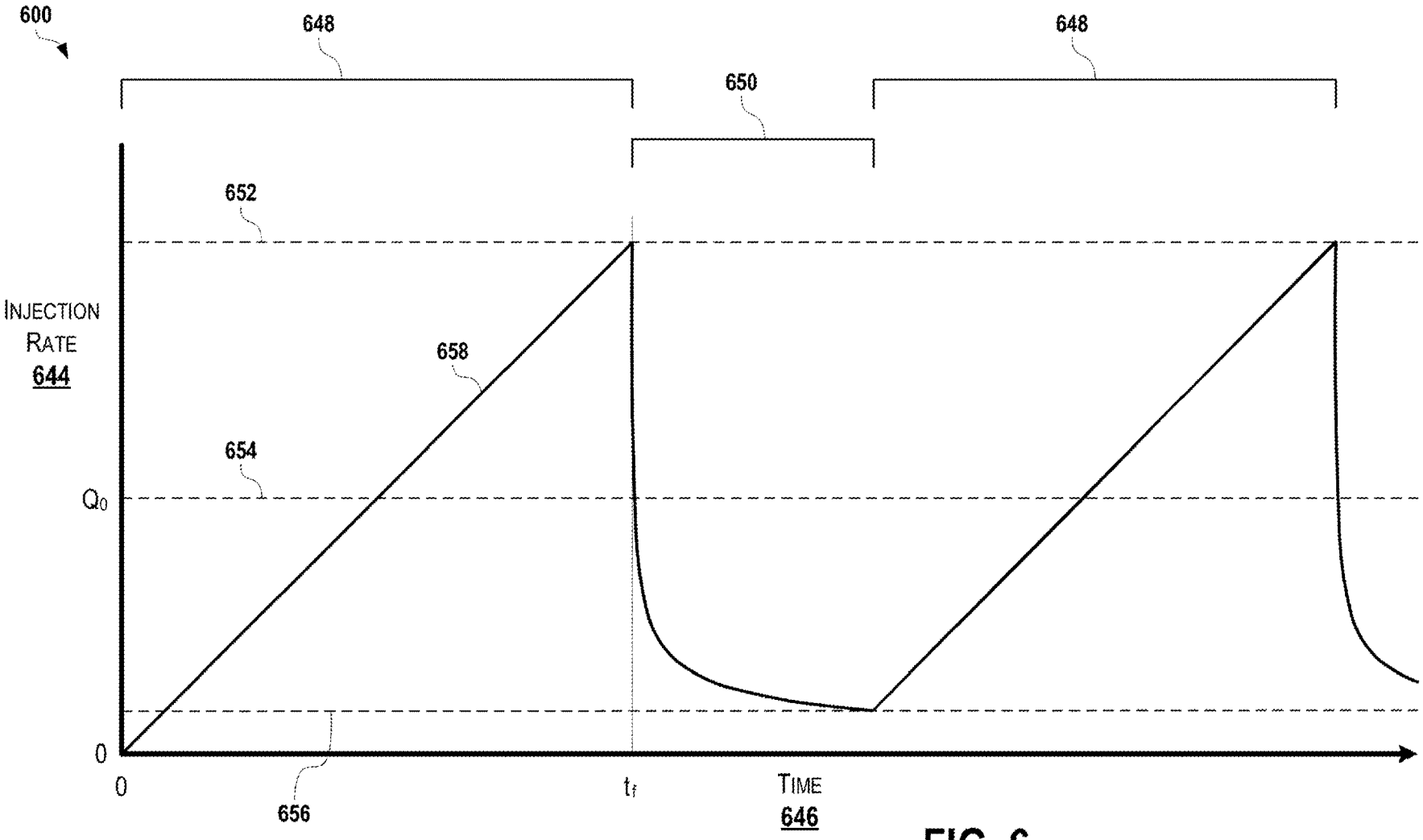
FIG. 6 is a chart depicting an enhanced recovery operation applying injection rate tuning of a first fashion according to certain aspects of the present disclosure.

FIG. 6 is a chart 600 depicting an enhanced recovery operation applying injection rate tuning of a first fashion according to certain aspects of the present disclosure. The chart 600 depicts injection rate 644 on the Y-axis and time 646 on the X-axis. Path 658 indicates the injection rate 644 of injection fluid with respect to time 646. At the beginning of the enhanced recovery operation (e.g., time=0), the injection rate 644 can be zero. During a monotonically increasing phase 648, the injection rate 644 may increase until a maximum level 652 is reached. Line 654 is an indicator depicting an example constant injection rate as might be used for a non-optimized enhanced oil recovery technique.

As seen in FIG. 6, the path 658 during the monotonically increasing phase 648 is linear, although it can be any other suitable shape. For example, the injection rate 644 during the monotonically increasing phase 648 can be defined by Equation 4, where Q(t) is the injection rate, $Q_0$ is a constant injection rate (e.g., for a non-optimized enhanced oil recovery technique), t is time, and $t_f$ represents the time required to inject a volume $Q_0 t_f$ of fluid.

$$Q(t) \propto \frac{2Q_0 t}{t_f} \qquad \text{Equation 4}$$

Accordingly, the monotonic relationship of Equation 4 can provide the same volume of injection fluid within the same duration of time (e.g., $t_f$), but because of its monotonically increasing nature, the amount of injection pressure applied early in the phase is relatively low and the amount of injection pressure applied late in the phase is relatively high. Therefore, the resistance to hydrodynamic instabilities can be maximized without needing to limit the volume or overall duration of time used to inject the injection fluid. Since hydrodynamic instabilities are minimized, the efficiency of the enhanced recovery operation is improved and more hydrocarbons can be extracted from the formation.

Once the injection rate 644 reaches the maximum level 652, the path 658 continues in a monotonically decreasing phase 650 in which the injection rate 644 decreases monotonically. While it is possible for the injection rate 644 to decrease below zero, the injection rate 644 during the monotonically decreasing phase 650 will generally not decrease below zero. In some cases, the injection rate 644 will decrease to zero. In other cases, the injection rate 644 will decrease to a lower limit 656.

In some cases, the path 658 during a monotonically decreasing phase 650 can be based on a power function (e.g., according to a power law), such as that shown in Equation 3. The use of a power function when monotonically decreasing the injection rate 644 can help prevent hydrodynamic instabilities by reducing the chance of existing viscous fingers bifurcating. Other types of functions can be used, such as those described above with reference to monotonically increasing the injection rate, as long as the function is appropriately adjusted to monotonically decrease the injection rate.

A monotonic cycle can include the monotonically increasing phase 648 and the monotonically decreasing phase 650. In some cases, a monotonically decreasing phase 650 is immediately followed by a monotonically increasing phase 648, such as a monotonically increasing phase 648 of a subsequent monotonic cycle.

In some cases, subsequent monotonic cycles can include the same or similarly shaped monotonically increasing phases 648 and monotonically decreasing phase 650 (e.g., including one or more of the general shape of the function, maximum levels, and lower limits) as compared to the previous monotonic cycle. However, in some cases, subsequent monotonic cycles can include monotonically increasing phases 648 and monotonically decreasing phases 650 that have any combination of different shapes, different maximum levels, and different lower limits than a previous monotonically increasing phase 648 or monotonically decreasing phase 650. In other words, tuning injection rates can include alternating between any types of monotonically increasing phases and any types of monotonically decreasing phases.

Figure 7:
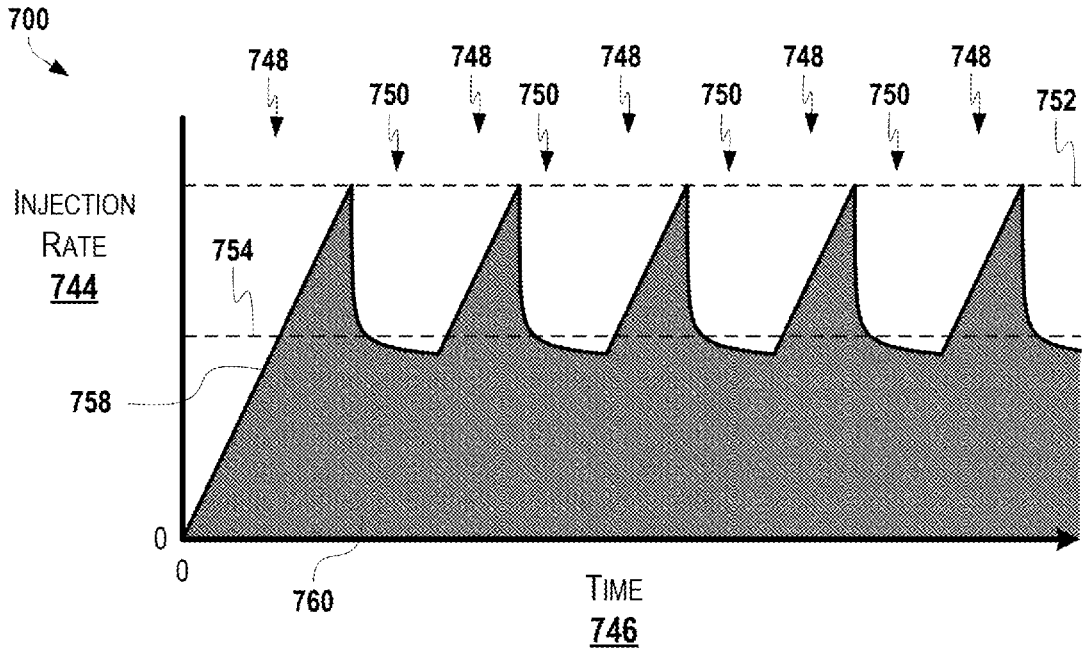
FIG. 7 is a chart depicting an enhanced recovery operation applying injection rate tuning of a second fashion according to certain aspects of the present disclosure.

FIG. 7 is a chart 700 depicting an enhanced recovery operation applying injection rate tuning of a second fashion according to certain aspects of the present disclosure. The chart 700 depicts injection rate 744 on the Y-axis and time 746 on the X-axis. Path 758 indicates the injection rate 744 of injection fluid with respect to time 746. At the beginning of the enhanced recovery operation (e.g., time=0), the injection rate 744 can be zero. During a monotonically increasing phase 748, the injection rate 744 may increase until a maximum level 752 is reached. Line 754 is an indicator depicting an example constant injection rate as might be used for a non-optimized enhanced oil recovery technique. Path 758 can include monotonically increasing phases 748 and monotonically decreasing phases 750 similar to respective phases associated with path 658 of FIG. 6, however, the monotonically decreasing phases 750 of FIG. 7 can reduce the injection rate 744 by substantially less than the monotonically decreasing phases 650 of FIG. 6 (e.g., to at or around line 754).

By not reducing the injection rate 744 substantially during monotonically decreasing phases 750, the overall volume of injection fluid 760 (e.g., as defined by the area under the curve) can be maintained at high levels while still maintaining relatively low risks of hydrodynamic instabilities.

Figure 8:
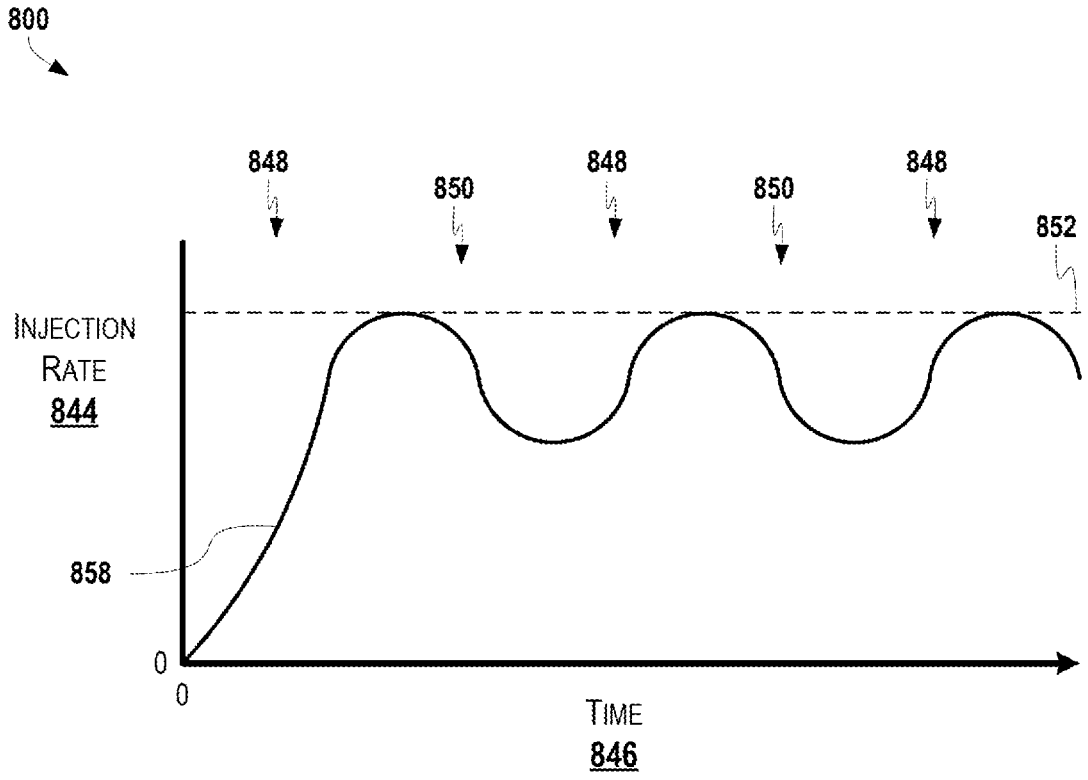
FIG. 8 is a chart depicting an enhanced recovery operation applying sinusoidal injection rate tuning according to certain aspects of the present disclosure.

FIG. 8 is a chart 800 depicting an enhanced recovery operation applying sinusoidal injection rate tuning according to certain aspects of the present disclosure. The chart 800 depicts injection rate 844 on the Y-axis and time 846 on the X-axis. Path 858 indicates the injection rate 844 of injection fluid with respect to time 846. At the beginning of the enhanced recovery operation (e.g., time=0), the injection rate 844 can be zero. During a monotonically increasing phase 848, the injection rate 844 may increase until a maximum level 852 is reached. Path 858 can include monotonically increasing phases 848 and monotonically decreasing phases 850 that are generally sinusoidal in shape.

Figure 9:
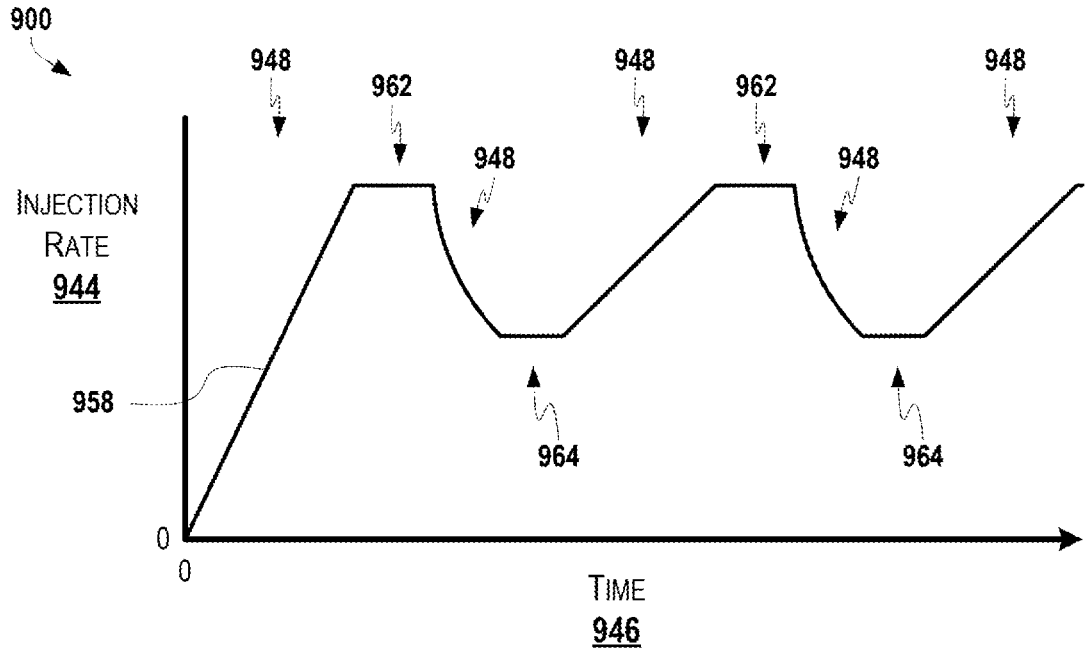
FIG. 9 is a chart depicting an enhanced recovery operation applying injection rate tuning with steady-state intervals according to certain aspects of the present disclosure.

FIG. 9 is a chart 900 depicting an enhanced recovery operation applying injection rate tuning with steady-state intervals 962, 964 according to certain aspects of the present disclosure. The chart 900 depicts injection rate 944 on the Y axis and time 946 on the X axis. Path 958 indicates the injection rate 944 of injection fluid with respect to time 946. At the beginning of the enhanced recovery operation (e.g., time=0), the injection rate 944 can be zero. During a monotonically increasing phase 948, the injection rate 944 may increase until a maximum level is reached. Path 958 can include monotonically increasing phases 948 and monotonically decreasing phases 950 that are similar to respective phases associated with path 658 of FIG. 6, however with the addition of steady-state intervals 962, 964, during which the injection rate 944 is held constant for a period of time 946. A first steady-state interval 962 can occur after a monotonically increasing phase 948 and before a monotonically decreasing phase 950. A second steady-state interval 964 can occur after a monotonically decreasing phase 950 and before a monotonically increasing phase 948.

Figure 10:
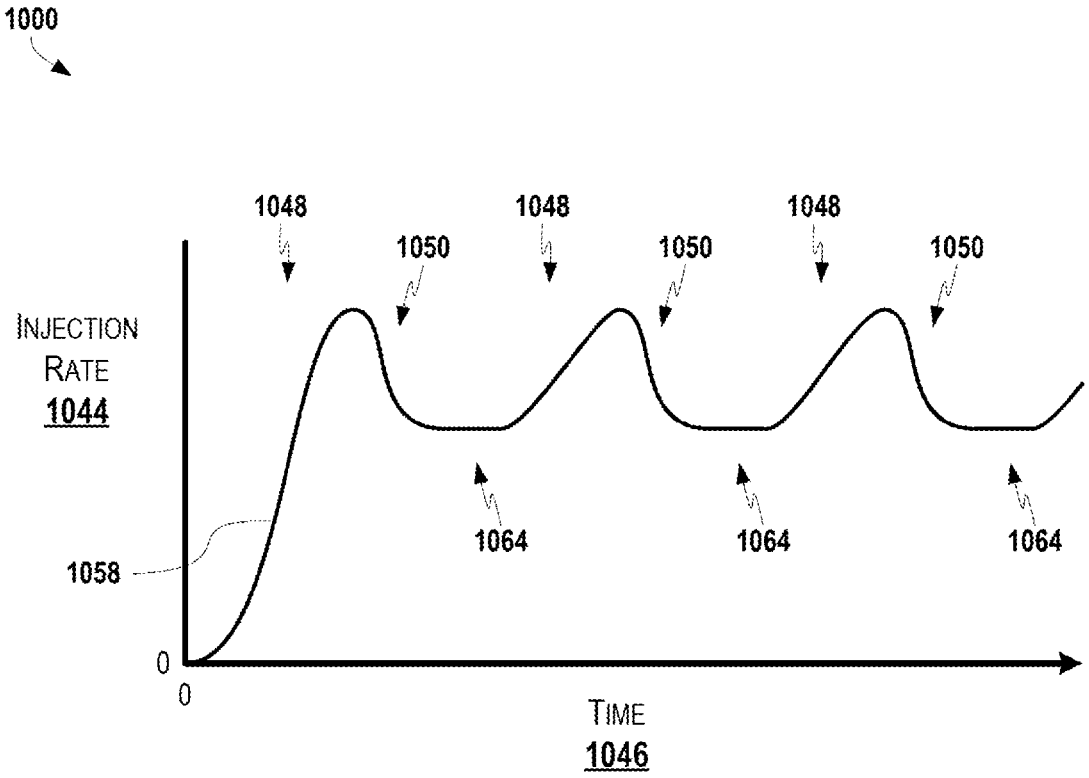
FIG. 10 is a chart depicting an enhanced recovery operation applying smooth injection rate tuning with steady-state intervals immediately following monotonically decreasing phases according to certain aspects of the present disclosure.

FIG. 10 is a chart 1000 depicting an enhanced recovery operation applying smooth injection rate tuning with steady-state intervals 1064 immediately following monotonically decreasing phases 1050 according to certain aspects of the present disclosure. The chart 1000 depicts injection rate 1044 on the Y-axis and time 1046 on the X-axis. Path 1058 indicates the injection rate 1044 of injection fluid with respect to time 1046. At the beginning of the enhanced recovery operation (e.g., time=0), the injection rate 1044 can be zero. During a monotonically increasing phase 1048, the injection rate 1044 may increase until a maximum level is reached. Path 1058 can include monotonically increasing phases 1048 and monotonically decreasing phases 1050, which may take shapes associated with logistic functions (e.g., sigmoid shapes). Monotonically decreasing phases 1050 can immediate follow monotonically increasing phases 1048, and steady-state intervals 1064 can immediately follow monotonically decreasing phases 1050 and can occur prior to subsequent monotonically increasing phases 1048.

Figure 11:
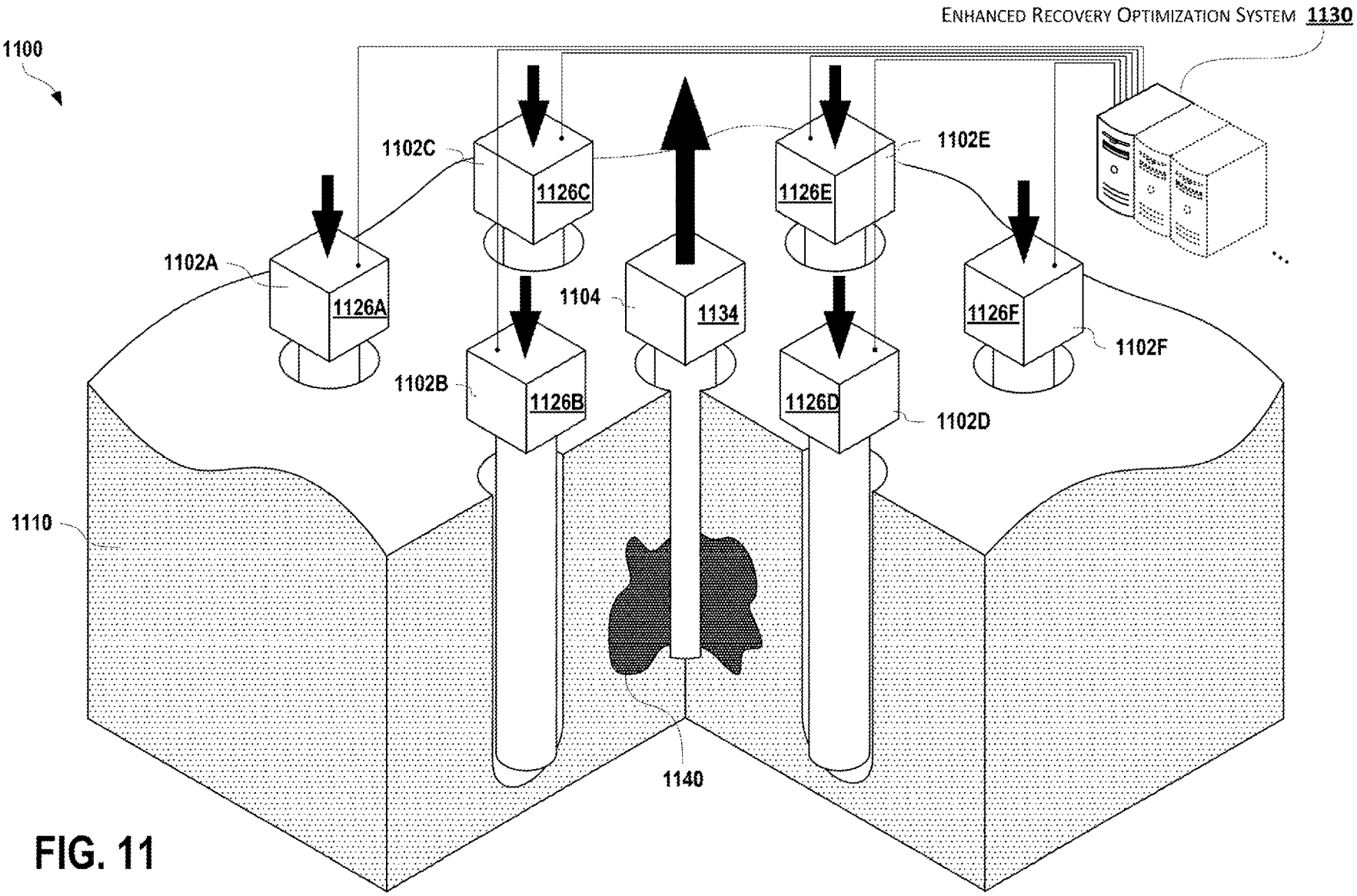
FIG. 11 is a combination schematic and block diagram of an enhanced oil recovery system including multiple wellbore injection systems and a wellbore servicing system according to certain aspects of the present disclosure.

FIG. 11 is a combination schematic and block diagram of an enhanced oil recovery system 1100 including multiple wellbore injection systems 1102A, 1102B, 1102C, 1102D, 1102E, 1102F and a wellbore servicing system 1104 according to certain aspects of the present disclosure. The wellbore injection systems 1102A-1102F can be located in a formation 1110 around a single wellbore servicing system 1104, although more than one wellbore servicing system 1104 can be used. The wellbore injection systems 1102A-1102F can be positioned opposite hydrocarbons 1140 in the formation 1110 from the wellbore servicing system 1104 such that injection fluid that is injected into the formation 1110 will displace the hydrocarbons 1140 towards the wellbore servicing system 1104. The wellbore servicing system 1104 can include an extraction pump 1134 to facilitate recovery of the hydrocarbons 1140.

Each of the wellbore injection systems 1102A-1102F can include a respective injection pump 1126A, 1126B, 1126C, 1126D, 1126E, 1126F capable of pressurizing injection fluid into the formation via respective conveyances (e.g., injection workstrings). An enhanced recovery optimization system 1130 can be coupled to the injection pumps 1126A-1126F to control the injection pumps 1126A-1126F. In some cases, the enhanced recovery optimization system 1130 can include a single controller or single piece of equipment coupled to all of the injection pumps 1126A-1126F and able to individually control each of the injection pumps 1126A-1126F. In some cases, the enhanced recovery optimization system 1130 can include multiple controllers, with each controller associated with one or more of the injection pumps 1126A-1126F (e.g., each controller associated with respective ones of the injection pumps 1126A-1126F). In such cases, the multiple controllers can be networked together, such as by wired or wireless networking. The enhanced recovery optimization system 1130 can control the injection pumps 1126A-1126F to provide injection rate tuning, such as monotonic cycling, to optimize or improve enhanced recovery techniques.

In some cases, monotonic cycling of injection rates can be applied individually to each of the wellbore injection systems 1102A-1102F. When applied individually, the enhanced recovery optimization system 1130 can control the operation of each of the injection pumps 1126A-1126F irrespective of other injection pumps 1126A-1126F. In other words, the injection rates of each individual wellbore injection system 1102A-1102F will be monotonically increasing or monotonically decreasing irrespective of the injection rates of other nearby wellbore injection systems 1102A-1102F.

In some cases, monotonic cycling of injection rates can be applied collectively across a set of wellbore injection systems 1102A-1102F. When injection rate tuning is applied collectively, the combined injection rates of all wellbore injection systems 1102A-1102F are considered in aggregate for monotonic cycling. In other words, the injection rate of an individual wellbore injection system (e.g., wellbore injection system 1102A) may be decreasing or increasing while the aggregate injection rate of the set of wellbore injection systems 1102A-1102F monotonically increases or decreases, respectively.

When aggregating injection rates from multiple wellbore injection systems, it can be desirable to only aggregate those injection rates attributable to wellbore injection systems having overlapping volumes of injection fluid in the formation 1110. For example, as seen in FIG. 11, wellbore injection systems 1102A, 1102B, and 1102C may be sufficiently close to one another such that their injection rates can be considered in aggregate. Likewise, wellbore injection systems 1102D, 1102E, and 1102F may be sufficiently close to one another for their injection rates to be considered in aggregate. However, wellbore injection systems 1102A and 1102F may be sufficiently distant from one another such that their injection rates should not be considered in aggregate. Computer modeling and simulation can aid in determining when injection rates for various wellbore injection systems should be aggregated.

In some cases, injection rates for wellbore injection systems 1102A-1102F can be controlled collectively, but not aggregately. The wellbore injection systems 1102A-1102F can be controlled using individual injection rate curves (e.g., such as the paths 658, 758, 858, 958, 1058, 1458 depicted in FIG. 6-10 or 14). Two or more of the injection rate curves may be the same, or each injection rate curve may be different, between the various wellbore injection systems 1102A-1102F. Each injection rate curve can be selected to optimize oil recovery given the particularities of a wellbore injection system 1102A-1102F, such as equipment used, injection fluid used, nearby formation characteristics (e.g., permeability), relative positions of the wellbore, and other variables.

Figure 12:
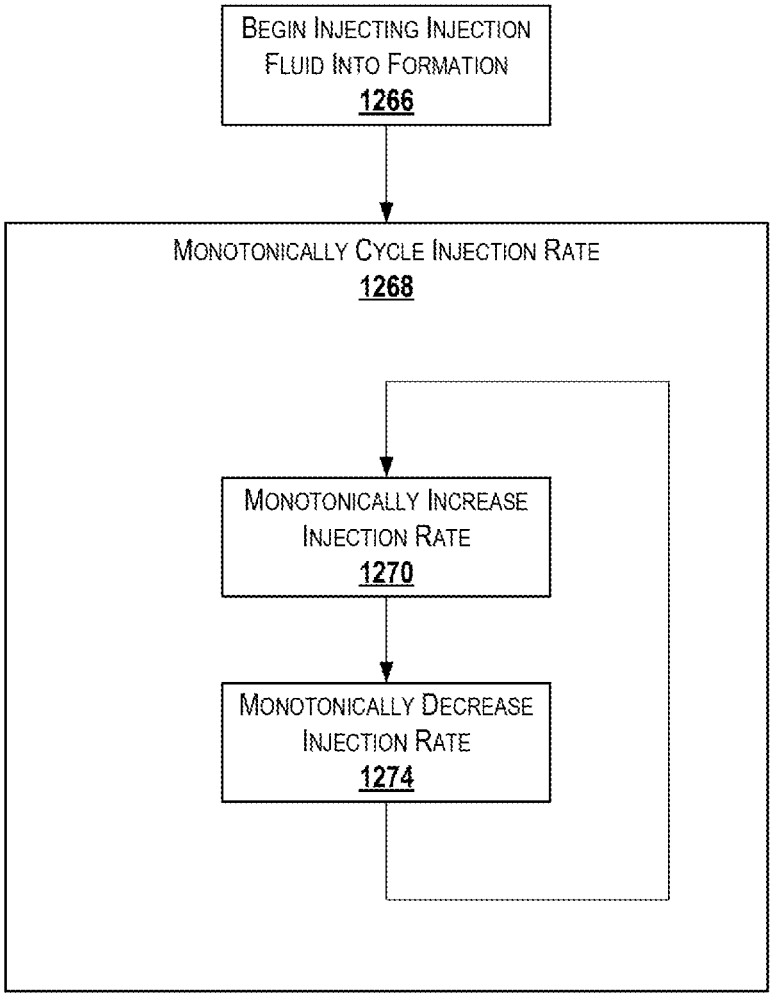
FIG. 12 is a flowchart depicting a process for tuning injection rates for an enhanced recovery operation according to certain aspects of the present disclosure.

FIG. 12 is a flowchart depicting a method 1200 for tuning injection rates for an enhanced recovery operation according to certain aspects of the present disclosure. At block 1266, injection fluid is injected into a formation. As described herein, injection fluid can be injected at a location opposite hydrocarbons from a production wellbore. The injection rate at block 1266 can be below a maximum limit.

At block 1268, the injection rate can be monotonically cycled. Monotonic cycling of the injection rate can repeat one or more times, until the desired enhanced recovery operation is complete. Monotonic cycling at block 1268 can include monotonically increasing the rejection rate at block 1270, followed by monotonically decreasing the rejection rate at block 1274. When an additional monotonic cycle is to be performed, the method 1200 returns to monotonically increasing the injection rate at block 1270 after finishing the monotonic decrease of the injection rate at block 1274.

In some cases, the durations for monotonically increasing and monotonically decreasing the injection rate can be on the order of several to tens of minutes or more. In some cases the duration for monotonically increasing the injection rate can be at least 10 seconds, 20 seconds, 30 seconds, 40 seconds, 50 seconds, or one minute. In some cases, the duration for monotonically decreasing the injection rate can be at least 2 seconds, 5 seconds, 10 seconds, 20 seconds, 30 seconds, 40 seconds, 50 seconds, or one minute. In some cases, the duration for monotonically decreasing the injection rate can be equal to or less than the duration for monotonically increasing the injection rate. In some cases, the duration for monotonically decreasing the injection rate can be equal to or less than half the duration for monotonically increasing the injection rate.

Figure 13:
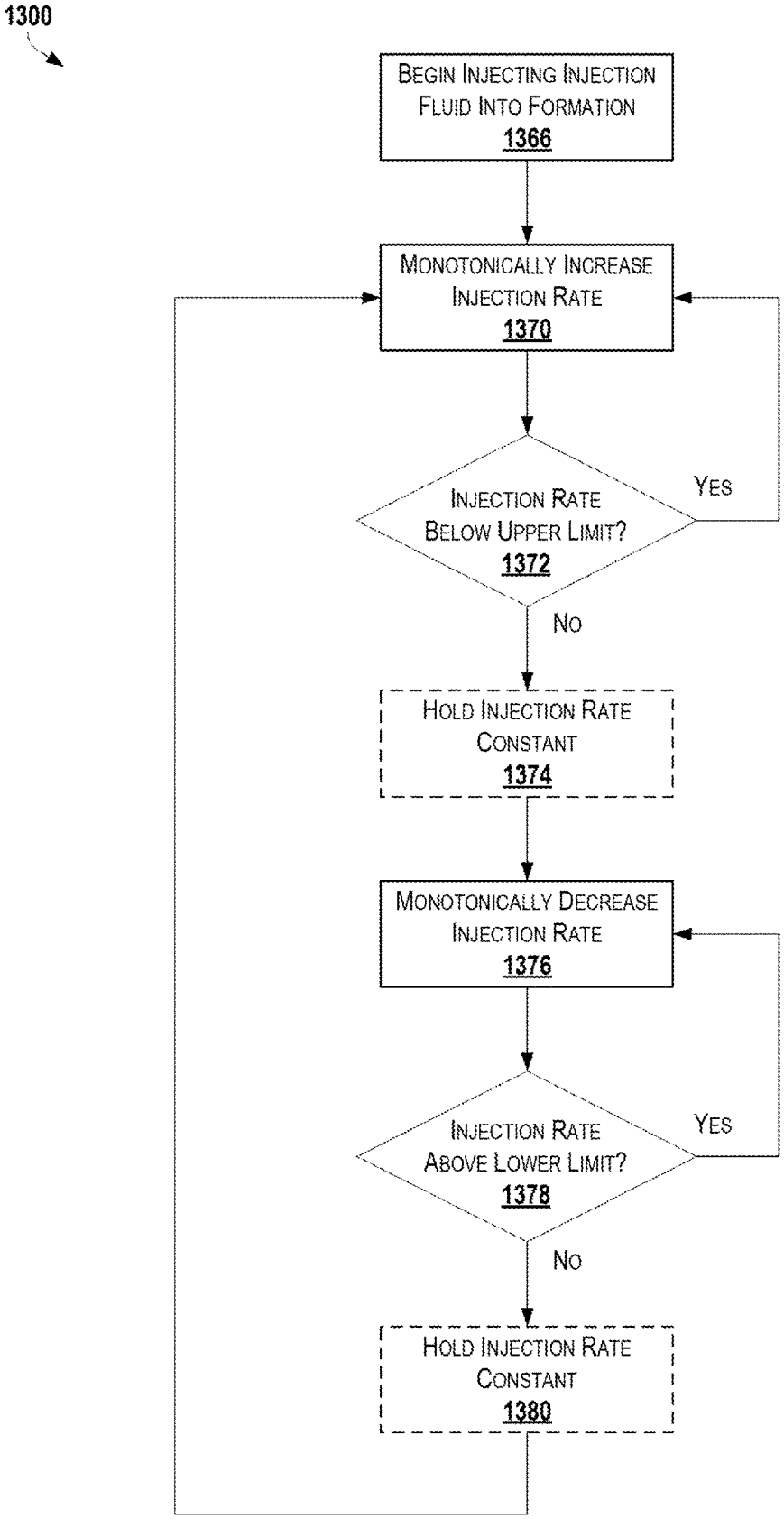
FIG. 13 is a flowchart depicting a process for tuning injection rates for an enhanced recovery operation according to certain aspects of the present disclosure.

FIG. 13 is a flowchart depicting a method 1300 for tuning injection rates for an enhanced recovery operation according to certain aspects of the present disclosure. At block 1366, injection fluid is injected into a formation. As described herein, injection fluid can be injected at a location opposite hydrocarbons from a production wellbore. The injection rate at block 1366 can be below an upper limit.

At block 1370, the injection rate can be monotonically increased. At block 1372, the injection rate can be compared to an upper limit. If the upper limit is not yet reached or surpassed (e.g., the injection rate is below the lower limit), the method 1300 can repeat block 1370 to monotonically increase the injection rate and then compare the new injection rate at block 1372. If the upper limit has been reached or surpassed, the method 1300 can continue on to optional block 1374 or block 1376. At optional block 1374, the injection rate can be held constant for a period of time before the method 1300 proceeds to block 1376.

At block 1376, the injection rate can be monotonically decreased. At block 1378, the injection rate can be compared to a lower limit. If the lower limit is not yet reached or surpassed (e.g., the injection rate is above the upper limit), the method 1300 can repeat block 1376 to monotonically decrease the injection rate and then compare the new injection rate at block 1378. If the lower limit has been reached or surpassed, the method 1300 can continue on to optional block 1380 or back to 1370. At optional block 1380, the injection rate can be held constant for a period of time before the method 1300 proceeds to block 1370.

Figure 14:
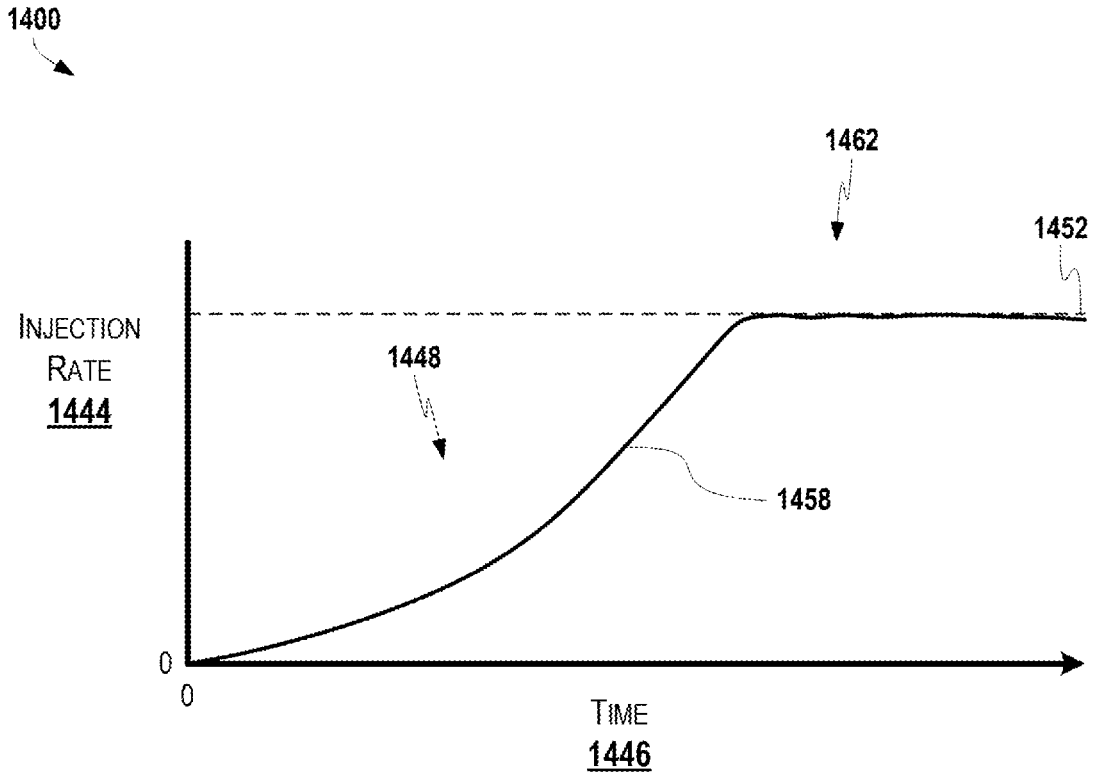
FIG. 14 is a chart depicting an enhanced recovery operation applying monotonically increasing injection rate tuning according to certain aspects of the present disclosure.
Figure 15:
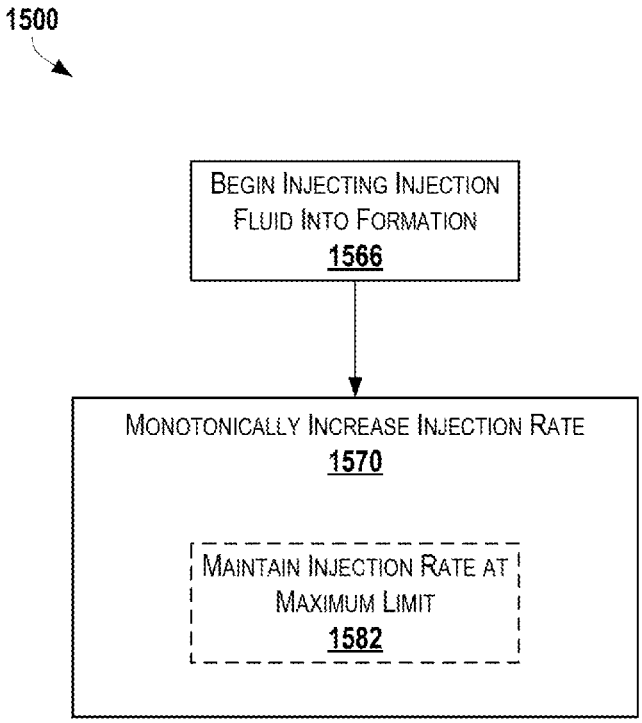
FIG. 15 is a flowchart depicting a method for tuning injection rates for an enhanced recovery operation without decreasing injection rates according to certain aspects of the present disclosure.

In some cases, such as those depicted in FIGS. 14-15, improved or optimized hydrocarbon recovery can be achieved without any decreasing phase, monotonic or otherwise. By starting the injection rate low, the injection rate begins sufficiently low so that fingers do not form while the interface between the injection fluid and the displaced fluid is relatively small due to the relatively low amount of injection fluid in the formation and relatively small pressure to disturb the interface. As the volume of injection fluid increases in the formation, the size of the interface between the injection fluid and displaced fluid increases, and thus higher injection rates are able to be maintained without substantial fingering, as described herein. Once a maximum injection rate is achieved (e.g., as set by engineering limits or by maximum injection rates where undesirable fingering is avoided), the injection rate can be maintained at that level until the process is complete. In some cases, the rate of increasing the injection rate can be set so that the maximum injection rate is achieved right when the process is complete, and thus no steady phase exists after a monotonically increasing phase.

FIG. 14 is a chart 1400 depicting an enhanced recovery operation applying monotonically increasing injection rate tuning according to certain aspects of the present disclosure. The chart 1400 depicts injection rate 1444 on the Y-axis and time 1446 on the X-axis. Path 1458 indicates the injection rate 1444 of injection fluid with respect to time 1446. At the beginning of the enhanced recovery operation (e.g., time=0), the injection rate 1444 can be zero. The injection rate 1444 can undergo a single monotonically increasing phase 1448 until the injection rate 1444 reaches a maximum level 1452. The maximum level 1452 can be defined as or by the engineering constraints of the system. Path 1458 can include a single monotonically increasing phase 1448 and no monotonically decreasing phases. The path 1458 can include a steady phase 1462 that holds the injection rate 1444 at or near the maximum level 1452. The monotonically increasing phase 1448 can take any suitable shape.

FIG. 15 is a flowchart depicting a method 1500 for tuning injection rates for an enhanced recovery operation without decreasing injection rates according to certain aspects of the present disclosure. At block 1566, injection fluid is injected into a formation. As described herein, injection fluid can be injected at a location opposite hydrocarbons from a production wellbore. The injection rate at block 1566 can be below a maximum limit.

At block 1570, the injection rate can be monotonically increased over time. The injection rate may monotonically increase until the maximum limit is reached. In some cases, monotonically increasing the injection rate at block 1570 can include maintaining the injection rate at the maximum limit at block 1582 for a duration. In other cases, monotonically increasing the injection rate at block 1570 can include ending the process once the maximum limit is reached.

Method 1500 can improve enhanced oil recovery techniques without the need to decrease the injection rate during the duration of the injection process. In other words, the injection rate monotonically increases for the entire duration of the injection process, with the injection rate either increasing or remaining constant throughout the injection process.

In some cases, the durations for monotonically increasing and monotonically decreasing the injection rate can be on the order of several to tens of minutes or more. In some cases the duration for monotonically increasing the injection rate can be at least 10 seconds, 20 seconds, 30 seconds, 40 seconds, 50 seconds, or one minute. In some cases, the duration for monotonically decreasing the injection rate can be at least 2 seconds, 5 seconds, 10 seconds, 20 seconds, 30 seconds, 40 seconds, 50 seconds, or one minute. In some cases, the duration for monotonically decreasing the injection rate can be equal to or less than the duration for monotonically increasing the injection rate. In some cases, the duration for monotonically decreasing the injection rate can be equal to or less than half the duration for monotonically increasing the injection rate.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a method of optimizing enhanced oil recovery, comprising providing injection fluid to a formation in proximity to a production wellbore at an injection rate; and monotonically increasing the injection rate of the injection fluid for a duration.

Example 2 is the method of example 1, wherein monotonically increasing the injection rate is performed as part of monotonically cycling the injection rate of the injection fluid, and wherein monotonically cycling the injection rate further includes monotonically decreasing the injection rate for a second duration.

Example 3 is the method of example 2, wherein monotonically decreasing the injection rate occurs after the injection rate reaches a maximum level.

Example 4 is the method of examples 2 or 3, wherein the second duration is equal to or less than the first duration.

Example 5 is the method of examples 2-4, wherein monotonically decreasing the injection rate includes decreasing the injection rate for the second duration according to a power law.

Example 6 is the method of examples 1-5, wherein monotonically increasing the injection rate includes linearly increasing the injection rate for the duration.

Example 7 is the method of examples 1-6, further comprising recovering hydrocarbons from the production wellbore, wherein providing the injection fluid includes increasing a pressure of the formation to facilitate production of the hydrocarbons from the production wellbore.

Example 8 is a system, comprising a tubular positionable in a wellbore for conveying injection fluid to a formation adjacent the wellbore; a pump fluidly coupled to the tubular to provide pressure suitable to force the injection fluid into the formation at an injection rate based on a pump rate of the pump; a controller coupled to the pump to adjust the pump rate of the pump; and a non-transitory computer-readable storage medium containing instructions that are executable by the controller to cause the controller to provide control signals to the pump to monotonically increase the injection rate of the injection fluid for a duration.

Example 9 is the system of example 8, wherein monotonically increasing the injection rate is performed as part of monotonically cycling the injection rate, and wherein monotonically cycling the injection rate further includes monotonically decreasing the injection rate for a second duration.

Example 10 is the system of example 9, wherein monotonically decreasing the injection rate occurs after the injection rate reaches a maximum level.

Example 11 is the system of examples 9 or 10, wherein the second duration is equal to or less than the first duration.

Example 12 is the system of examples 9-11, wherein monotonically decreasing the injection rate includes decreasing the injection rate for the second duration according to a power law.

Example 13 is the system of examples 9-12, wherein monotonically cycling the injection rate includes continuously alternating between monotonically increasing the injection rate and monotonically decreasing the injection rate.

Example 14 is the system of examples 8-13, wherein monotonically increasing the injection rate includes linearly increasing the injection rate for the duration.

Example 15 is a method, comprising pressurizing injection fluid into a formation adjacent a production wellbore at an injection rate, wherein pressurizing the injection fluid includes increasing the injection rate to an upper rate over a duration, wherein the injection rate does not decrease during the duration.

Example 16 is the method of example 15, wherein pressurizing the injection further includes continuously alternating between increasing the injection rate to the upper rate over the duration and decreasing the injection rate from the upper rate over a second duration, wherein the injection rate does not increase during the second duration.

Example 17 is the method of example 16, wherein decreasing the injection rate includes decreasing the injection rate with respect to time over the second duration according to a power law.

Example 18 is the method of examples 16 or 17, wherein the second duration is equal to or less than the first duration.

Example 19 is the method of examples 15-18, wherein increasing the injection rate includes linearly increasing the injection rate with respect to time over the first duration.

Example 20 is the method of examples 15-19, further comprising recovering hydrocarbons from the production wellbore, wherein pressurizing the injection fluid into the formation includes increasing a pressure of the formation to facilitate recovering the hydrocarbons from the production wellbore.

What is claimed is:

1. A method of optimizing enhanced oil recovery, comprising:

providing injection fluid to a formation in proximity to a production wellbore by collectively controlling an injection rate for a plurality of wellbore injection systems; and cycling the injection rate of the injection fluid for at least some of the plurality of wellbore injection systems, wherein the cycling of the injection rate includes decreasing the injection rate with a rate of decrease inversely proportional to a cubic root of time.

2. The method of claim 1, wherein the decreasing of the injection rate occurs after the injection rate reaches a maximum level.

3. The method of claim 1, wherein cycling the injection rate includes monotonically increasing the injection rate for a first duration and the decreasing of the injection rate occurs for a second duration, and wherein the second duration is equal to or less than the first duration.

4. The method of claim 1, wherein cycling the injection rate includes linearly increasing the injection rate.

5. The method of claim 1, further comprising recovering hydrocarbons from the production wellbore, wherein providing the injection fluid includes increasing a pressure of the formation to facilitate production of the hydrocarbons from the production wellbore.

6. A system, comprising:

a plurality of tubulars positionable in a wellbore for conveying injection fluid to a formation adjacent the wellbore;

a plurality of pumps fluidly coupled to the plurality of tubulars to provide pressure suitable to force the injection fluid into the formation at an injection rate based on a pump rate;

a controller coupled to the plurality of pumps to adjust the pump rate of the plurality of pumps; and a non-transitory computer-readable storage medium containing instructions that are executable by the controller to cause the controller to collectively provide control signals to the plurality of pumps to cycle the injection rate of the injection fluid for at least some of the plurality of pumps, wherein cycling the injection rate includes decreasing the injection rate with a rate of decrease inversely proportional to a cubic root of time.

7. The system of claim 6, wherein the decreasing of the injection rate occurs after the injection rate reaches a maximum level.

8. The system of claim 6, wherein cycling of the injection rate includes monotonically increasing the injection rate for a first duration and the decreasing of the injection rate occurs for a second duration, and wherein the second duration is equal to or less than the first duration.

9. The system of claim 6, wherein cycling the injection rate includes continuously alternating between monotonically increasing the injection rate and decreasing the injection rate.

10. The system of claim 9, wherein monotonically increasing the injection rate includes linearly increasing the injection rate.

11. A method, comprising:

pressurizing injection fluid into a formation adjacent a production wellbore by collectively controlling an injection rate for a plurality of wellbore injection systems, wherein pressurizing the injection fluid includes cycling the injection rate for at least some of the plurality of wellbore injection systems, wherein the cycling of the injection rate includes decreasing the injection rate with a rate of decrease inversely proportional to a cubic root of time.

12. The method of claim 11, wherein cycling the injection rate further includes continuously alternating between increasing the injection rate to an upper rate over a first duration and decreasing the injection rate from the upper rate over a second duration, wherein the injection rate does not increase during the second duration, and wherein the second duration is equal to or less than the first duration.

13. The method of claim 12, wherein increasing the injection rate includes linearly increasing the injection rate with respect to time.

14. The method of claim 11, further comprising recovering hydrocarbons from the production wellbore, wherein pressurizing the injection fluid into the formation includes increasing a pressure of the formation to facilitate recovering the hydrocarbons from the production wellbore.

* * * * *